US006141813A

United States Patent [19]

De Guzman

[11] Patent Number: 6,141,813

[45] Date of Patent: Nov. 7, 2000

[54] SELF-WRINGING MOP AND WRINGER ASSEMBLY, CLEANING ELEMENT ASSEMBLY AND CLEANING ELEMENT FOR USE WITH SAME

[75] Inventor: Joselito De Guzman, Redondo Beach, Calif.

[73] Assignee: Micronova Manufacturing Inc., Torrance, Calif.

[21] Appl. No.: 08/993,200

[22] Filed: Dec. 18, 1997

Related U.S. Application Data

[63] Continuation-in-part of application No. 08/804,809, Feb. 24, 1997, Pat. No. 5,933,904, which is a continuation of application No. 08/486,914, Jun. 7, 1995, Pat. No. 5,606,760.

[51] Int. Cl.[7] ..... A47L 13/20

[52] U.S. Cl. ..... 15/119.2; 15/244.1; 15/244.4

[58] Field of Search ..... 15/119.1, 119.2, 15/98, 147.2, 244.1, 244.2, 244.3, 244.4, 149, 150

[56] References Cited

U.S. PATENT DOCUMENTS

| | | | |
|---|---|---|---|
| 2,176,908 | 10/1939 | Korner et al. . | |
| 2,572,978 | 10/1951 | Bogan | 15/119.2 |
| 2,844,837 | 7/1958 | Mackert | 15/150 |
| 2,866,991 | 1/1959 | Chao | 15/119.2 |
| 2,977,625 | 4/1961 | Hopkins . | |
| 3,037,229 | 6/1962 | Anderson | 15/119.2 |
| 3,076,216 | 2/1963 | Anderson . | |
| 3,105,258 | 10/1963 | Lopez | 15/119.2 |
| 3,166,774 | 1/1965 | Blum | 15/119.2 |
| 3,220,040 | 11/1965 | Knaebe . | |
| 3,233,269 | 2/1966 | Scheffold . | |
| 3,872,536 | 3/1975 | Siemund | 15/244.1 |
| 4,464,807 | 8/1984 | Weiss . | |
| 4,571,766 | 2/1986 | Goldman et al. . | |
| 4,908,901 | 3/1990 | Torres . | |
| 5,067,197 | 11/1991 | Cormier . | |
| 5,381,579 | 1/1995 | Sartori | 15/119.2 |
| 5,701,628 | 12/1997 | Morad | 15/150 |

*Primary Examiner*—James Hook
*Attorney, Agent, or Firm*—Henricks, Slavins & Holmes LLP

[57] ABSTRACT

A self-wringing mop includes a powered actuator device operably connected to a cleaning element assembly for moving the cleaning element assembly from a use position to a wringing position. A cleaning element, which may be used with a self-wringing mop, includes a main body defining a top surface, a bottom surface and at least one aperture associated with the main body and passing completely through the main body from the top surface to the bottom surface. A bracket, which may be used with the cleaning element, includes a holding member and at least one bracket attachment member extending through the at least one aperture and adapted to be secured to a mop's cleaning element assembly attachment member. A wringer head assembly, which may be used with the self-wringing mop, includes a mounting rod, a roller mounted on the mid-portion of the mounting rod, and an end cap mounted on each of the ends of the mounting rod. A torsion control device may also be included on the wringer head assembly, as may a base adapted to be inserted into a hollow mop handle.

39 Claims, 13 Drawing Sheets

FIG. 1
PRIOR ART
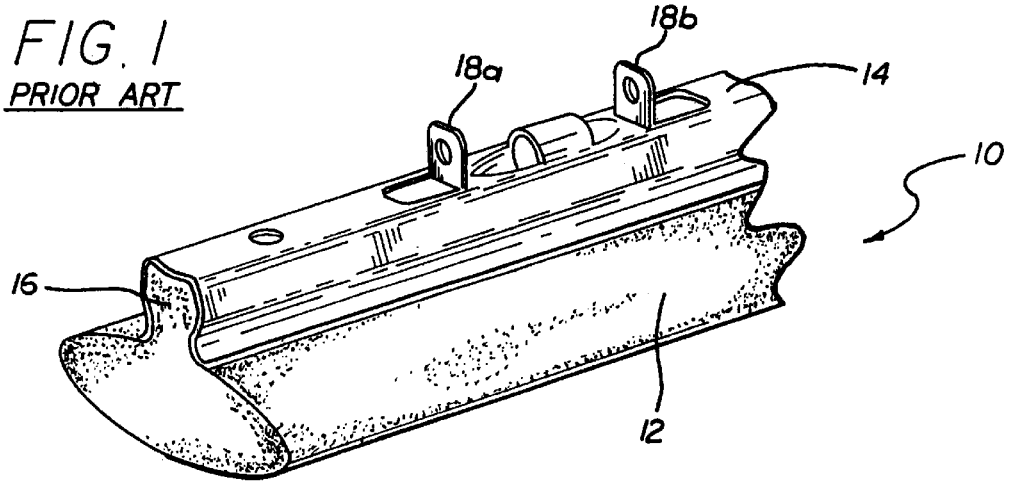
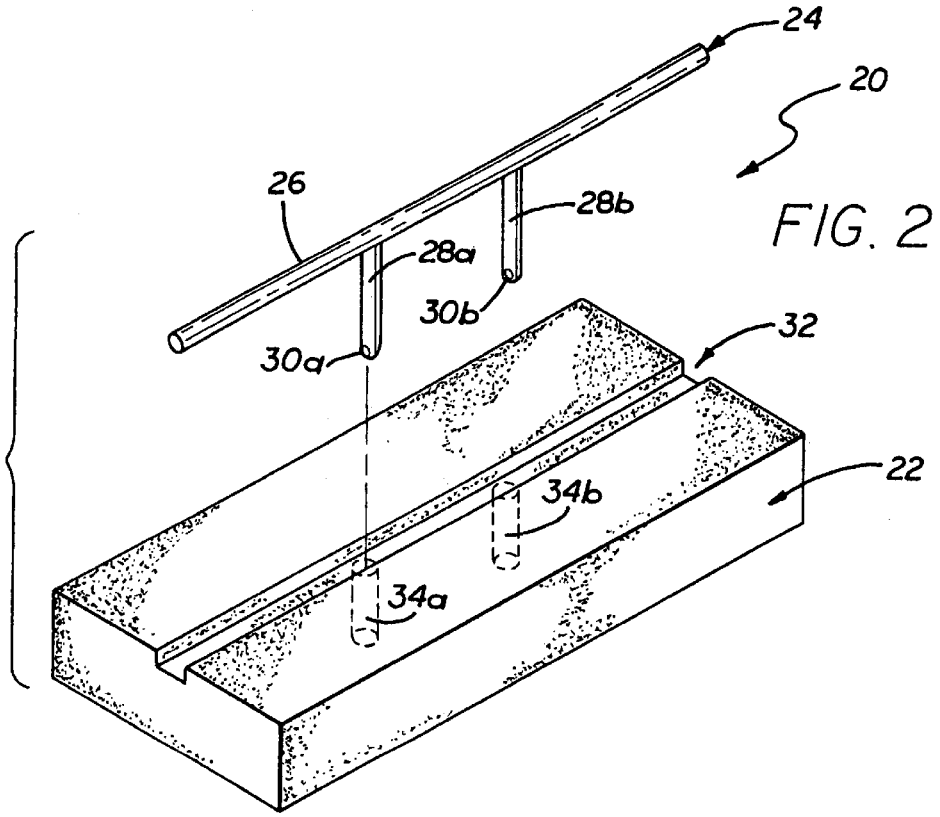
FIG. 2

FIG. 3
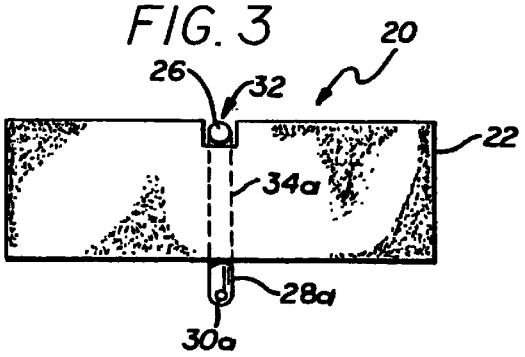
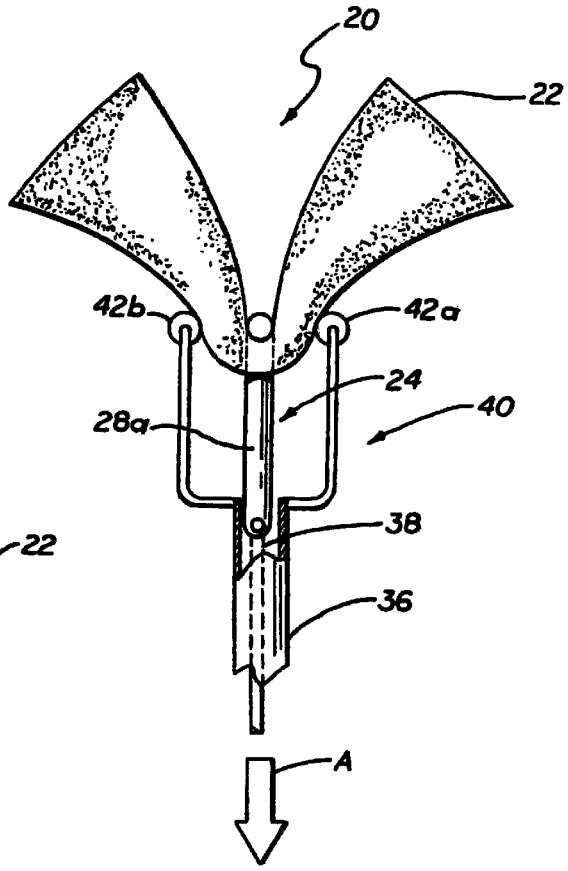
FIG. 4
FIG. 6
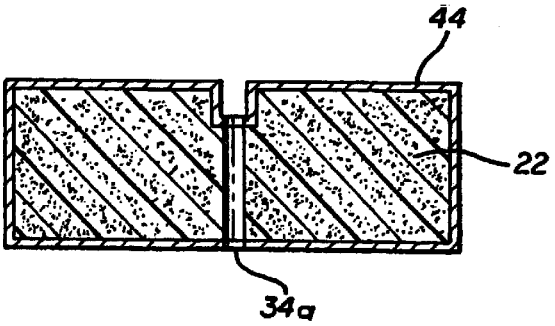

FIG. 13
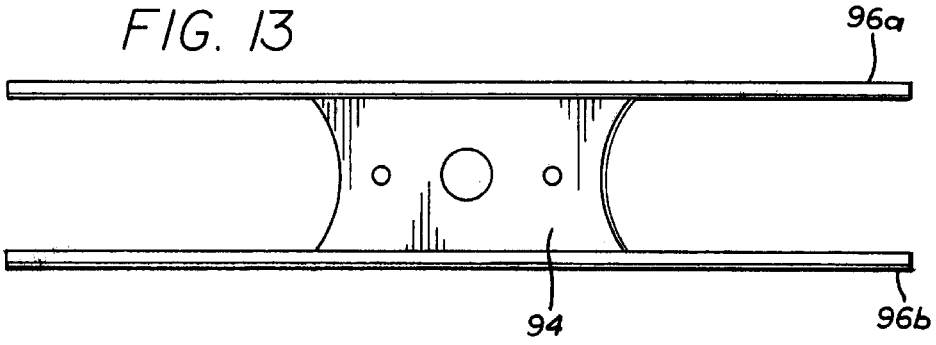
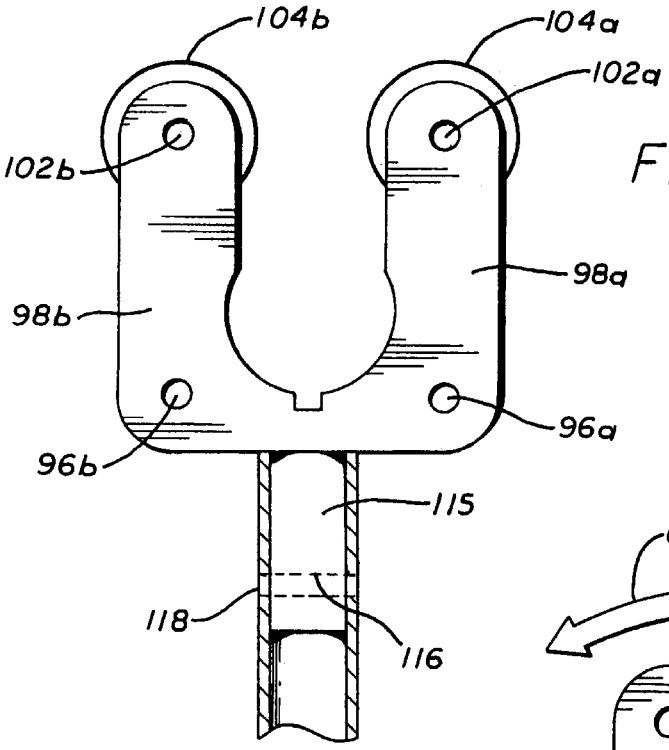
FIG. 14
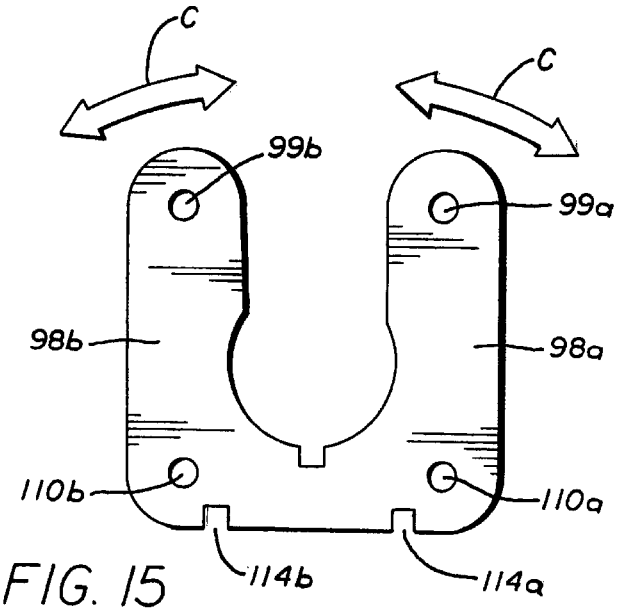
FIG. 15

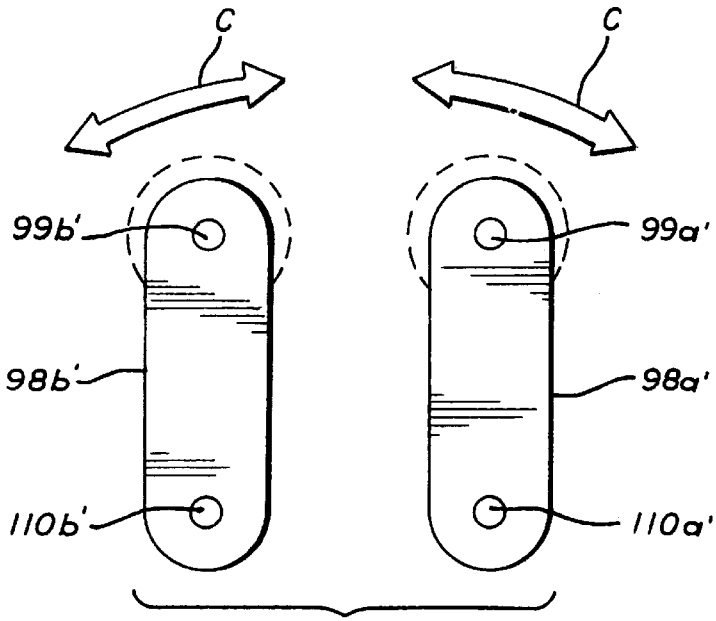
FIG. 16
FIG. 17
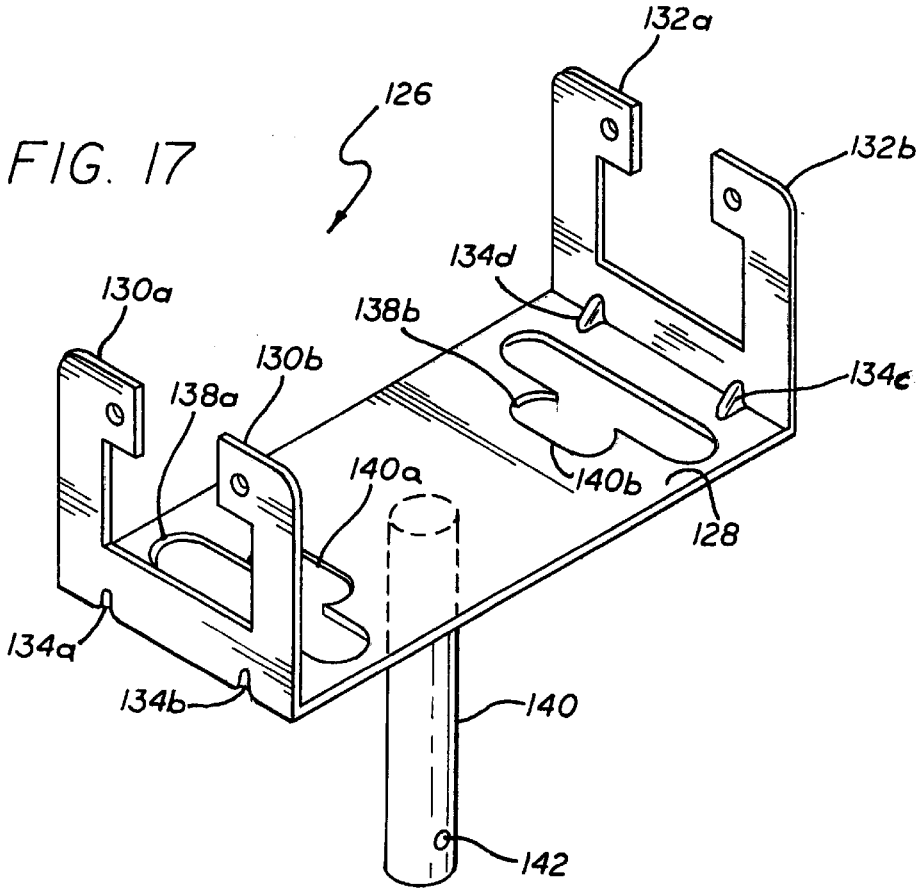

SELF-WRINGING MOP AND WRINGER ASSEMBLY, CLEANING ELEMENT ASSEMBLY AND CLEANING ELEMENT FOR USE WITH SAME

CROSS REFERENCE TO RELATED APPLICATIONS

This is a continuation-in-part of Ser. No. 08/804,809 filed Feb. 24, 1997 now U.S. Pat. No. 5,933,904, which is a continuation of Ser. No. 08/486,914 filed Jun. 7, 1995 now U.S. Pat. No. 5,606,760.

BACKGROUND OF THE INVENTION

1. Field of Invention

The present invention relates generally to self-wringing mops and, more particularly, to self-wringing mops that can accept a replacement cleaning element assembly and to such replacement cleaning element or mop head assemblies.

2. Description of the Related Art

Self-wringing mops, which include a replaceable sponge assembly that is movable between a cleaning, or use, position and a wringing position, are well known. The sponge assembly is typically connected to an actuator rod, which is itself connected to a lever that is manually operated by the person using the mop. When the user moves the lever away from the sponge assembly, the rod pulls the sponge assembly through a pair of rollers held by a wringer head assembly. The rollers apply pressure to the sponge to wring liquid from the sponge. The lever may then be moved in the opposite direction to return the sponge assembly to the cleaning position. One example of a conventional self-wringing sponge mop is the so-called roll-o-matic sponge mop.

The sponge assemblies employed in self-wringing sponge mops are typically composed of a sponge held by a metal clamp adapted to be connected to the actuator rod. The metal clamp holds the sponge in place and serves as an adapter which allows the sponge assembly to be connected to the mop. One example of a sponge assembly is illustrated in U.S. Pat. No. 4,908,901, which issued in 1990 to Torres.

There are a number of disadvantages associated with conventional self-wringing sponge mops in general, and with conventional sponges, sponge assemblies, and wringer head assemblies in particular.

Turning first to the sponge assemblies, many of the disadvantages associated with conventional sponge assemblies derive from the metal clamp which holds the sponge. The clamp covers and holds a significant portion of the sponge. The covered and clamped portion of the sponge is not affected by the squeezing force applied by the rollers. As such, bacteria, dirt and other contaminants can become trapped within this portion of the sponge, as can moisture, which leads to the growth of mildew. The clamps also include sharp edges which can scratch persons using the mop, the surfaces being mopped and items on or adjacent to these surfaces and possibly produce other contaminants such as particulates. Other shortcomings of conventional sponge assemblies relate to the fact that the clamp is permanently affixed to the sponge and is discarded with the sponge when the sponge is worn out. Not only is it wasteful to throw away a clamp which is not itself worn out, but the clamp cannot be compressed and adds significant weight and volume to the material which is to be disposed of Thus, disposal of conventional sponge assemblies can be especially expensive in situations where the sponge mop is being used in conjunction with hazardous substances that cannot be disposed of by conventional techniques. Finally, as the clamp must be manufactured and attached to the sponge, it adds a significant amount to the cost of the sponge assembly.

Another disadvantage associated with conventional sponge assemblies is related to covers which are sometimes used to cover the sponge. Covers are often composed of material such as polyvinyl alcohol (PVA) and provide a relatively non-linting, smooth and absorbent cleaning surface. However, due to the manner in which sponges are attached to conventional clamps, the cover separates from the sponge as the sponge passes through the rollers. This prevents the rollers from wringing liquid, dirt and other contaminants from the cover.

The shape of the sponge used in conventional sponge assemblies can also be improved. For example, the portion of the sponge's total surface area that is actually available for scrubbing or wiping is limited. In addition, the side portions of the sponge tend to be narrow and not well adapted for scrubbing. As such, conventional sponge assemblies do not make efficient use of the sponge's potentially available scrubbing surface and cannot be as easily used to clean walls and other vertically extending surfaces as desired.

With respect to the self-wringing sponge mops themselves, a significant amount of force must be applied to the lever in order to pull the sponge through the rollers and wring liquid from the sponge. A similar amount of force must be applied to return the sponge to the use position. Accordingly, use of conventional self-wringing sponge mops over prolonged periods can be quite fatiguing. Moreover, the amount of force required to operate the lever is often greater than that which can be generated by persons of somewhat limited physical capabilities, such as those afflicted with disabilities.

The wringer head assembly of conventional self-wringing sponge mops can also be troublesome. For example, the ends of the roller mounting rods often become exposed and can scratch persons using the mop, the surfaces being mopped, and items on or adjacent to these surfaces. In addition, bacteria, dirt and other contaminants often enter the mop's tubular handle at the point of connection between the handle and the wringer head assembly. Such contaminants can escape during subsequent uses of the mop. Conventional wringer head assemblies also tend to be formed from two pressed pieces of sheet metal. Each piece supports a single roller. Such an arrangement makes it particularly difficult to control the amount of assembly flexing during wringing processes. In addition, such assemblies are riveted to the mop handle, thereby reducing the flexibility of the mop and making it difficult to replace a damaged assembly. The configuration of conventional wringer head assemblies also makes it difficult to replace the sponge assembly.

Accordingly, a need exists for a sponge assembly having both an improved sponge holding apparatus and a more efficient sponge design. A need also exists for a self-wringing sponge mop which does not require the person using the mop to manually apply a significant amount of force to drive the sponge from the use position, through the rollers, and then back again. There is also a need for a roller assembly which is less likely to cause scratching and allow contaminants into the mop's handle, and which is capable of controlled flexing and easy replacement.

SUMMARY OF THE INVENTION

The present inventions provide an improved self-wringing mop which reduce or obviate, for practical purposes, one or more of the aforementioned problems in the art. The present inventions help to provide an improved wipe, cleaner, sponge or other cleaning element assembly which reduces the cleanliness, safety, wastefulness and waste disposal problems associated with conventional sponge assemblies. They also provide an improved cleaning element which has a larger portion of its surface area available for scrubbing and which is adapted for use on vertically extending surfaces. In one embodiment, an improved self-wringing mop pulls the cleaning element through the rollers and returns it to the use position without the application of a significant amount of force by the user. In another embodiment, an improved wringer head assembly reduces the amount of bacteria, dirt and other contaminants that enter the mop's handle at the connection point between the handle and the wringer head assembly. Another embodiment has a wringer head assembly which will flex in a controlled manner and which can be easily replaced.

In one embodiment of a cleaning element in accordance with the present invention, a main body defines a top surface and a bottom surface, and includes at least one aperture associated with the main body and passing completely through the main body from the top surface to the bottom surface. A preferred embodiment of a cleaning element assembly in accordance with the present invention includes the cleaning element described above in combination with a bracket including a holding member and at least one bracket attachment member. The bracket attachment member extends from the holding member through the at least one aperture and is adapted to be secured to a corresponding attachment member on the mop.

There are a number of advantages associated with the preferred cleaning element and cleaning element assembly. For example, the preferred bracket does not cover and hold a significant portion of the cleaning element. Thus, the preferred bracket permits bacteria, dirt, moisture and other contaminants to be wrung from large portions of the cleaning element, compared to conventional clamps. The preferred bracket also lacks the sharp edges associated with conventional clamps and, therefore, does not tend to scratch surfaces which come into contact with the cleaning element assembly. Another advantage of the preferred cleaning element assembly is that the bracket does not have to be permanently attached to the cleaning element, as do conventional clamps. Only the cleaning element need be replaced when it is worn. Accordingly, the waste and manufacturing costs associated with providing a new clamp with every new cleaning element are eliminated. So are the disposal problems associated with having to dispose of a clamp with every worn cleaning element. Another benefit of not permanently attaching the cleaning element to the device used to secure the cleaning element to the mop is that the cleaning element may be configured in such a manner that when one side of the cleaning element is worn, the cleaning element may be separated from the bracket and turned over for continued use. Such a cleaning element may last approximately twice as long as a similar cleaning element employed in a conventional sponge assembly.

When a cover is used to cover the cleaning element in the preferred cleaning element assembly, the holding member helps to prevent the cover from separating from the cleaning element. Thus, liquid, dirt and other contaminants will be more effectively wrung from the cover than they would if conventional cleaning element assemblies were used.

The preferred cleaning elements themselves may be provided in a number of shapes. Such flexibility allows the cleaning elements to be specifically designed for particular tasks. For example, the sides of the cleaning element may be somewhat wide so as to facilitate the cleaning of vertically extending surfaces.

One embodiment of a self-wringing mop in accordance with present invention includes an actuator device, operably connected to a cleaning element assembly, for moving the cleaning element assembly from the use position to the wringing position. The actuator device reduces the need for the user to apply a significant amount of force to a lever in order to move the cleaning element assembly into the wringing position and then back to the use position. Therefore, the present self-wringing mop is less fatiguing than conventional self-wringing mops and may be more easily used by persons of limited physical capabilities.

A wringer head assembly in accordance with the present invention may also include a mounting rod, a roller mounted on the mid-portion of the mounting rod, and an end cap mounted on each of the ends of the mounting rod. The end caps minimize scratching associated with the conventional wringer head assemblies. In addition, the end caps may be configured such that they function as additional portions of the rollers. A torsion control device may also be included, as may a base adapted to be inserted into a hollow mop handle. The torsion control device allows the wringer head assembly to flex in a controlled manner and the base allows the wringer head assembly to be easily replaced and reduces the chance of liquid entering the handle. The wringer head assembly may also configured such that members that support the mounting rods will not interfere with the removal and replacement of the cleaning elements.

A cleaning element assembly is also described for use with a mop, the mop including at least one cleaning element assembly attachment member. The cleaning element assembly includes a cleaning element having a main body extending longitudinally and an opening extending longitudinally through the body for accepting a portion of a cleaning element bracket. The bracket includes at least two holding elements, such as bars, one of which extends into the opening, for sandwiching or positioning at least part of the cleaning element between the at least two bars. This arrangement provides for a more stable cleaning element during use which does not bunch or migrate as much as some designs, for example, is easy to assemble, use, and replace or exchange. It can be used with a variety of cleaning element configurations.

In one preferred embodiment, the opening in the cleaning element extends the entire longitudinal length of the cleaning element, and wherein one of the rods of the bracket extends entirely through the opening from one side of the cleaning element to the other. The at least two bars then sandwich or position part of the cleaning element between them to hold and stabilize the cleaning element. The assembly can then be mounted for use on a mop handle.

In a further preferred form of the inventions, a bracket having two bars, one of which extends entirely through a longitudinally extending opening in the cleaning element, sandwiches part of the material between the two rods. In one form, the two rods of the bracket are hinged at one end and releasably latched at the other end to sandwich part of the material between them. The opening is centered in the cleaning element, and in another embodiment, the opening is positioned as much as one-third the distance or more below one surface of the cleaning element. In the last configuration, more than 50% and even two-thirds or more of the material is then sandwiched between the two bars. The opening can also be positioned so that less than 50% of the material is sandwiched between the bars.

In a further preferred form of the inventions, the bracket includes three bars, one center or intermediate bar for extending through an opening in the cleaning element, as well as two external bars for sandwiching or positioning adjacent material between the respective bar and the intermediate bar. In this configuration, material on both sides of the intermediate bar is pressed against the intermediate bar by the respective outer bar. This configuration provides symmetry and a relatively more stable structure.

In a further preferred form of the inventions, one of the bars of the at least two bars in the bracket includes tangs or mounting elements for mounting the assembly to a mop handle or other cleaning implement.

In still another preferred form of the inventions, the cleaning element includes sufficient material to extend beyond the lateral edges of the bracket to minimize the possibility of the bracket touching or scraping walls, floors, or other structures while in use.

In still another preferred form of the inventions, two holding bars are positioned on opposite sides of a cleaning element to form a bracket for holding and positioning the cleaning element between them. Apertures may be formed in the cleaning element to accept joining bars for joining the spaced-apart bars or rods, thereby sandwiching the material between the rods. The rods, both in this embodiment as well as the other embodiments, can take any number of shapes and surface textures to facilitate reliable holding of the cleaning material. For example, one or more of the rods can include projections extending into the cleaning material, such as claws, teeth or other holding elements for engaging the cleaning material.

In a further preferred form of the invention, a holding bracket includes one or more clips or clamp bars for extending through the cleaning material to engage and/or lock with a base rod to sandwich and hold the cleaning material between the two rods. Holding and locking can be accomplished by detents, locking bars, locking shafts, ratchets, and the like.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

FIG. 1 is a perspective view of a conventional sponge assembly.

FIG. 2 is an exploded perspective view of a cleaning element assembly in accordance with one aspect of the present invention.

FIG. 3 is an assembled side view of the cleaning element assembly shown in FIG. 2.

FIG. 4 is a side view showing the cleaning element assembly shown in FIG. 3 being used in conjunction with a self-wringing mop.

FIG. 6 is a section view of the cleaning element shown in FIG. 2 which includes a cover.

FIG. 13 is a top view of a portion of the wringer head assembly shown in FIG. 12.

FIG. 14 is a side view of the wringer head assembly shown in FIG. 12.

FIG. 15 is a plan view of a pair of roller axis support members which may be used in conjunction with the wringer head assembly shown in FIG. 12 combined to form a unitary structure.

FIG. 16 is a plan view of a pair of roller axis support members which may be used in conjunction with the wringer head assembly shown in FIG. 12.

FIG. 17 is a perspective view of another embodiment of a wringer head assembly in accordance with the present inventions.

DETAILED DESCRIPTION OF THE PREFERRED EMBODIMENTS

Figure 5:
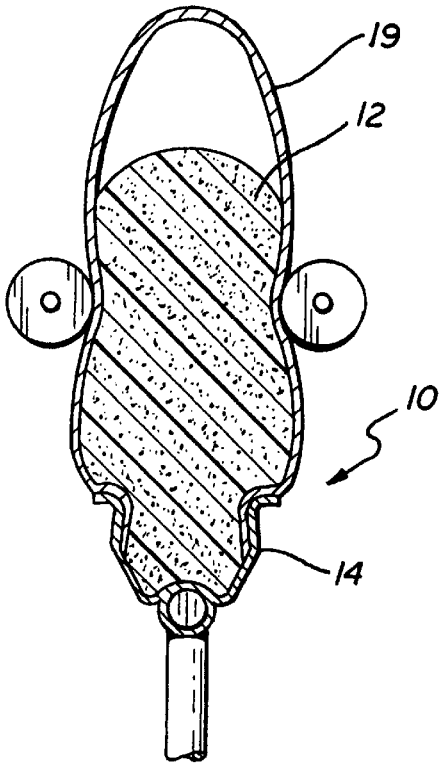
FIG. 5 PRIOR ART
FIG. 5 is a section view of a conventional sponge assembly which includes a sponge cover being used in conjunction with a self-wringing mop.

The following is a detailed description of a number of preferred embodiments of the present invention. This description is not to be taken in a limiting sense, but is made merely for the purpose of illustrating the general principles of the invention. The scope of the invention is defined by the appended claims.

As illustrated in FIG. 1, conventional self-wringing sponge mop assemblies, such as that generally indicated by reference numeral 10, include a sponge 12 which is held by a clamping member 14. Clamping member 14 is permanently secured to sponge 12 and occupies a significant portion 16 of the sponge. This portion will not be compressed when the sponge assembly is pulled through a wringer. As such, contaminants such as dirt and bacteria can be trapped in this portion of the sponge. Also, because the clamp is permanently secured to the sponge, it must be discarded with the sponge when the sponge is worn, which is costly and inefficient. Clamping member 14 includes a pair of tabs 18*a* and 18*b* having apertures formed therein.

The apertures are used to connect clamping member 14 to a pair of resilient connectors associated with the self-wringing mop's actuator rod.

Turning to the one of the preferred embodiments, which is illustrated in FIGS. 2 and 3, a cleaning element assembly in accordance with the present invention (generally indicated by reference numeral 20) includes a cleaning element 22 and a bracket 24. The preferred bracket includes a horizontally extending portion 26 and at least one but preferably a pair of bracket members 28*a* and 28*b*. The illustrated bracket members include a pair of apertures 30*a* and 30*b* which may be used to connect the bracket to a pair of resilient connectors associated with a self-wringing mop's actuator rod. A plurality of longitudinally spaced apertures (not shown) may also be provided on each bracket member so that the bracket may be used with cleaning elements having a variety of thickness.

The present construction secures the cleaning element without preventing a significant portion of the cleaning element from being wrung. As a result, dirt, moisture and other contaminants will be more effectively wrung from the present cleaning element then they will from conventional clamp and sponge assemblies. In addition, the bracket does not have to be permanently attached to the cleaning element. Thus, it does not have to be discarded when the cleaning element needs be replaced. Finally, there need not be any sharp edges associated with the present bracket, thereby substantially reducing the scratching and the potential production of particulates associated with the conventional arrangements.

When the cleaning element assembly is in the assembled state shown in FIG. 3, horizontally extending portion 26 of the bracket rests in a channel 32 formed on the surface of cleaning element 22 and bracket members 28*a* and 28*b* extend through a pair of apertures 34*a* and 34*b*, respectively. The channel may be rectangular, as shown in FIGS. 2 and 3, or may be rounded, triangular or other shapes. In addition, the channel may be formed on both sides of the cleaning element. Thus, when one side of the cleaning element is spent, the cleaning element may be turned over for continued use. The shape of the bracket members and the horizontally extending portion may also be varied.

In accordance with the preferred embodiment, the bracket may be formed from electro-polished stainless steel. However, other materials, such as aluminum, steel or plastic, may be used. Turning to the dimensions of the preferred bracket, it is approximately 14 inches long and ⅜" in diameter. Clearly, the present invention is not limited to the exemplary materials and dimensions may be adapted as needed for specific applications.

The overall configuration of cleaning element assembly 20 is not limited to the preferred embodiment shown in FIGS. 2 and 3. Rather, the configuration may be varied in order to adapt the cleaning element assembly to a variety of self-wringing cleaning element mops. For example, the end of the actuator rod in certain types of self-wringing mops is threaded. In this case, bracket 24 could be provided with a single bracket member having a threaded receptacle adapted to receive the threaded end of the rod. The cleaning element used with such a bracket would be provided with a single aperture extending therethrough. The single bracket member could also be eliminated and a threaded receptacle could be provided on the longitudinally extending portion of the bracket. Here, the threaded rod would extend through the cleaning element to the receptacle. The end of the actuator arm in another type of self-wringing mop is L-shaped and includes a small end portion extending at a right angle therefrom. Here, the longitudinally extending portion of the bracket would be fitted with a tunnel adapted to receive the small, right angle end portion of the rod and the aperture in the cleaning element could shaped and sized accordingly.

Figure 10:
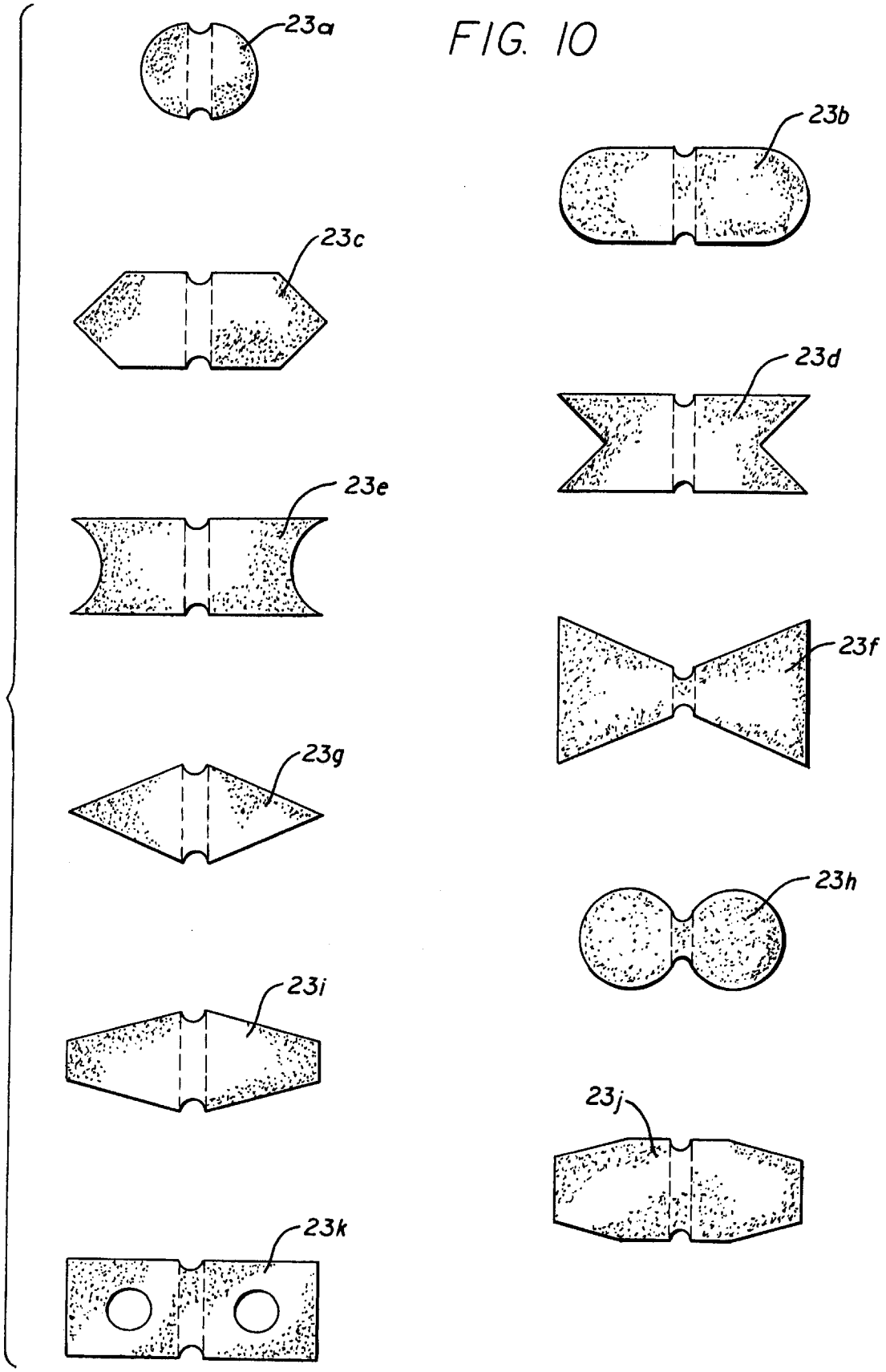
FIG. 10 is a plurality of section views of cleaning elements having a variety cross-sectional shapes.

The configuration of the cleaning element itself is not limited to a cleaning element with a generally rectangular cross-section, such as that shown in FIGS. 2 and 3. Rather, the shape of the cross-section may be varied in accordance with the intended use of the cleaning element. As illustrated for example in FIG. 10, the cross-section of the cleaning element may be round (cleaning element 23*a*), generally rectangular with rounded sides (cleaning element 23*b*), generally rectangular with outwardly pointed sides (cleaning element 23*c*), generally rectangular with inwardly pointed sides (cleaning element 23*d*), generally rectangular with concave rounded sides (cleaning element 23*e*), resemble a bow tie (cleaning element 23*f*), resemble two juxtaposed triangles (cleaning element 23*g*), resemble two juxtaposed circles (cleaning element 23*h*), resemble two juxtaposed triangles with squared-off ends (cleaning element 23*i*), generally rectangular with chamfered corners (cleaning element 23*j*), and generally rectangular with holes extending therethrough (cleaning element 23*k*). Additionally, scrubbing pads may be affixed to various portions, or all, of the outer surface of the cleaning element. Finally, the aperture(s) extending through the cleaning element are not limited to a generally round cross-section. Rather, the cross-section of the aperture(s) may be any shape or may be nothing more than a slit which will deform as a bracket member or other device passes therethrough.

The cleaning element may be formed from any suitable cleaning and/or absorbent material. For example, the cleaning element may be composed of a sponge or sponge-like material, or PVA (other examples). It is intended that the term cleaning element encompass all such materials, whether presently known or later developed. Preferably, the cleaning element is composed of polyurethane or PVC coated polyurethane foam.

As shown by way of example in FIG. 4, the present cleaning element assembly 20 may be connected to a self-wringing mop including a handle 36, an actuator rod 38 and a wringer head assembly 40. When the rod moves in the direction indicated by arrow A, bracket 24 is pulled in the same direction and cleaning element 22 is pulled between a pair of rollers 42*a* and 42*b*. The rollers exert pressure on the cleaning element and wring liquid therefrom. Moreover, the cleaning element may be shaped such that it may be used to grasp objects when in the wringing position shown in FIG. 4.

Figure 7:
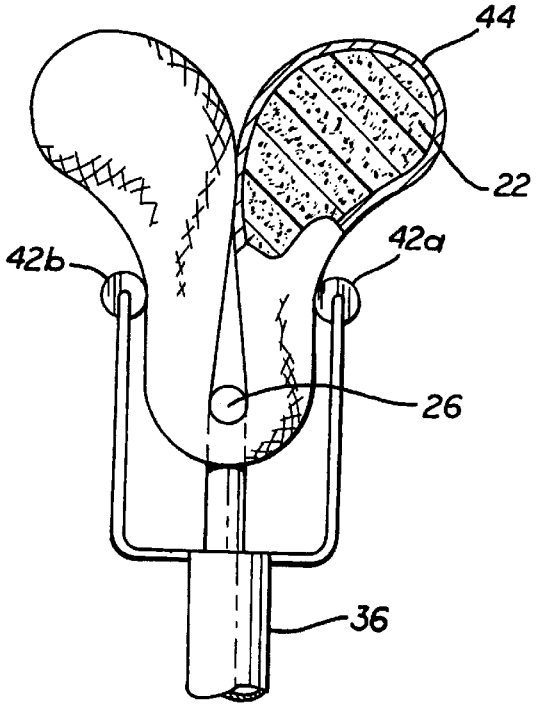
FIG. 7 is a side, partial section view showing the cleaning element assembly shown in FIG. 6 being used in conjunction with a self-wringing mop.

FIG. 5 shows a conventional sponge assembly, such as that illustrated in FIG. 1, with a sponge cover 19 added to the assembly. When the conventional sponge assembly is pulled through the wringer head assembly's rollers, the cover separates from the sponge. Such separation prevents wringing of the cover. Turning to FIGS. 6 and 7, the cleaning element in the present cleaning element assembly may also be fitted with a cover. Specifically, cleaning element 22 may also be provided with a cover 44 composed of PVA, WhiteliteTM, or other suitable materials known to those skilled in the art. The cover may cover the entire surface of the cleaning element or, alternatively, only a selected portion. When cleaning element assembly 20 is pulled through wringer head assembly rollers 42*a* and 42*b*, the bracket's horizontally extending portion 26 pulls cover 44 against the cleaning element. This advantageously prevents the cover from separating from the cleaning element and insures that the cover will be wrung with the cleaning element. As a result, liquid, dirt and other contaminants will not remain in the cover after wringing, as is often the case with conventional designs.

Figure 8:
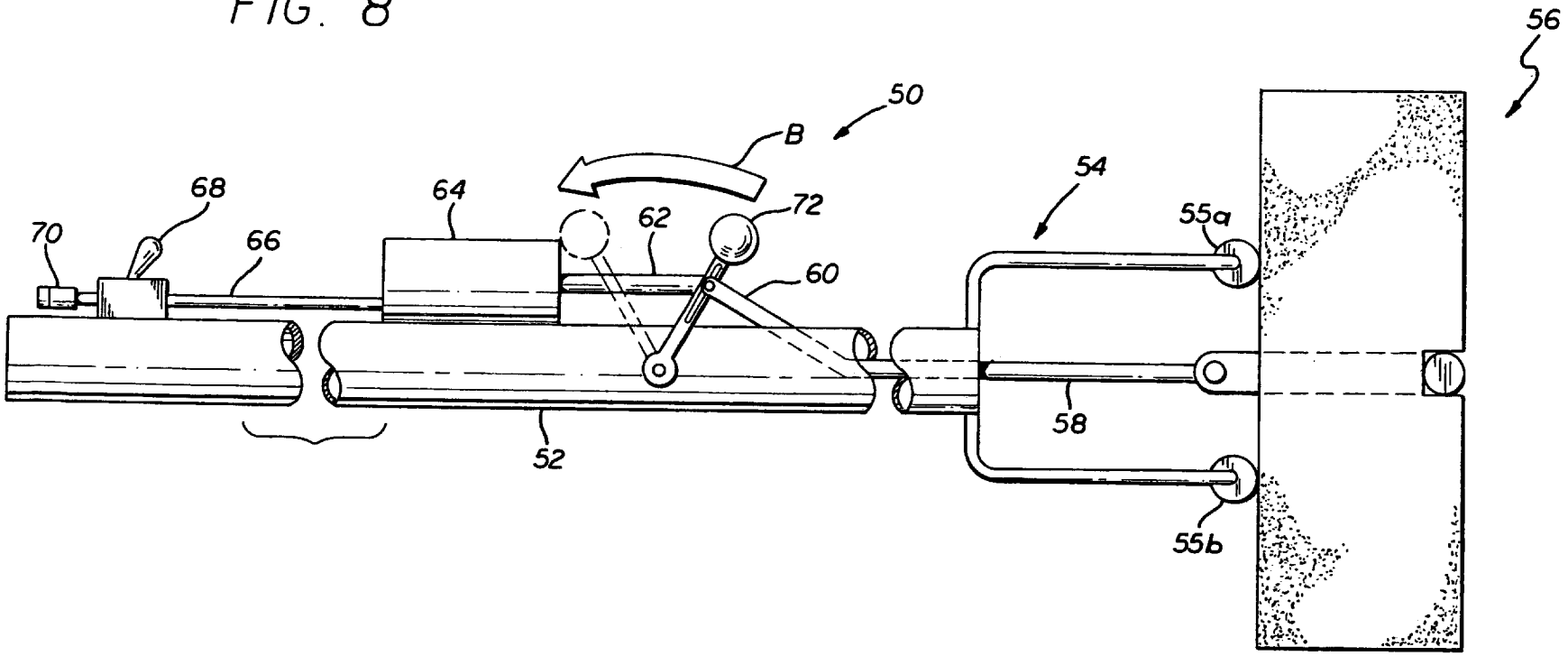
FIG. 8 is a side view of a powered self-wringing mop.

As illustrated for example in FIG. 8, a powered self-wringing mop in accordance with the present invention is generally indicated by reference numeral 50 and includes a handle 52 and a wringer head assembly 54 affixed to one end of the handle. The wringer head assembly includes rollers 55*a* and 55*b*. A cleaning element assembly 56 is operably connected to a rod 58 which extends through handle 52. The illustrated cleaning element assembly is of the type illustrated in FIG. 2. However, the powered self-wringing mop is not limited to use with any particular cleaning element assembly and may be used in conjunction with any cleaning element assembly, including that illustrated in FIG. 1. Rod 58 is connected by a linkage 60 to a pneumatic piston 62 and cylinder 64. The piston is pulled in the direction indicated by arrow B, i.e. into the cylinder, when gas is introduced into the cylinder through line 66. Such movement of piston 62 pulls the cleaning element assembly into the wringing position within the wringer head assembly. As a result, the user of the mop does not have to supply a significant amount of force to a handle in order to wring liquid and dirt from the cleaning element. When the gas is released, an internal spring forces piston 62 out of cylinder 64 and cleaning element assembly 56 is returned to the use position. The flow of gas through line 66 is controlled by a valve 68 that is connected to a source of compressed gas through a "quick-release" type connector 70. The valve is also capable of venting air. The powered self-wringing mop illustrated in FIG. 8 also includes a lever 72 that is connected to linkage 60. The lever may be used to move the mop head assembly to and from the wringing position when compressed gas is unavailable.

Figure 9:
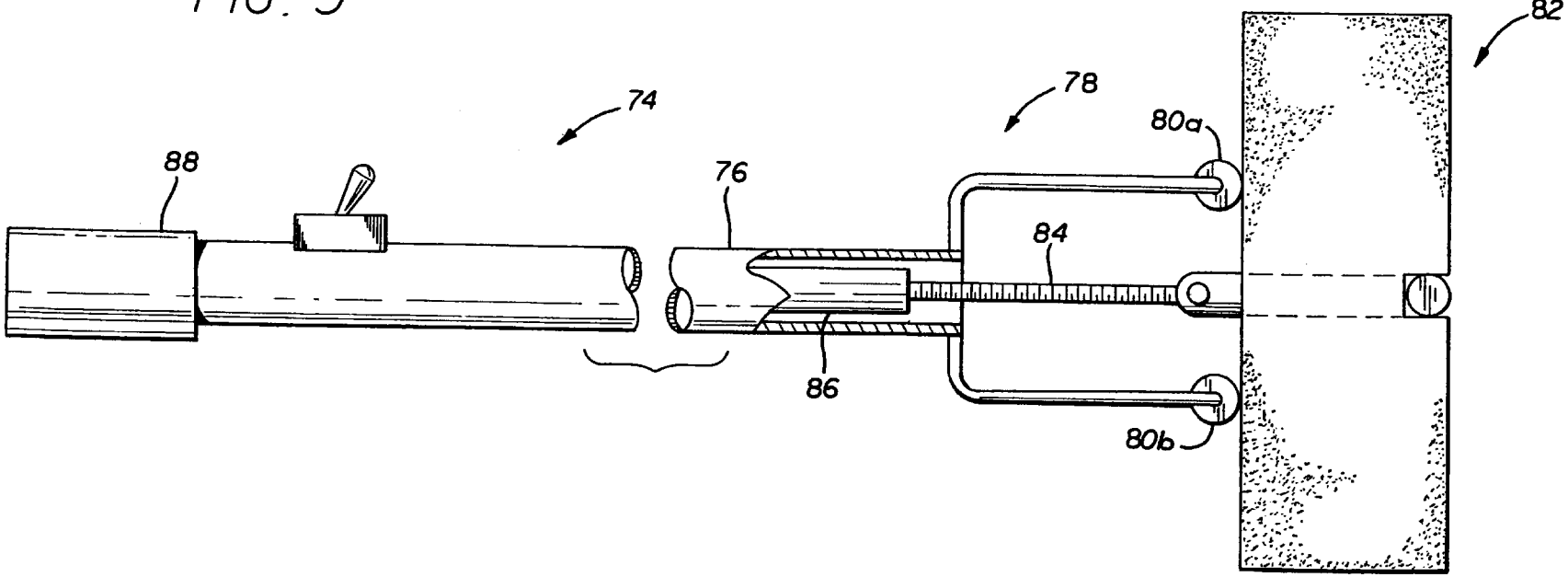
FIG. 9 is a side view of another powered self-wringing mop.

Another example of a powered self-wringing mop is illustrated in FIG. 9. The mop, which is generally indicated by reference numeral 74, includes a handle 76 and a wringer head assembly 78 affixed to one end of the handle. The wringer head assembly includes rollers 80*a* and 80*b*. A cleaning element assembly 82 is operably connected to one end of a screw 84 which extends through handle 76. The other end of the screw is connected to an internally threaded rotating cylindrical member 86. Rotation of the cylindrical member, which is caused by a bi-directional motor 88, causes the screw to move relative to the handle, thereby causing mop head assembly 82 to be moved to and from the wringing position. Thus, the user of the mop does not have to manually provide the force necessary to wring the cleaning element. The motor may be either an AC motor or a DC motor, and if necessary, a power converter may be provided on the mop. The flow of current to the motor is controlled by a switch 90. So is the direction of the motor. Current may be supplied to the motor through an electrical cord or by a battery housed on the mop itself.

It should be noted that a number of other powering devices may be employed in place of the pneumatic piston and cylinder and electric motor/rotating cylinder arrangements described above. Such devices include hydraulic piston and cylinder units, sprocket and pulley arrangements, lead screw and follower arrangements, and other similar devices known to those skilled in the art.

Figure 11:
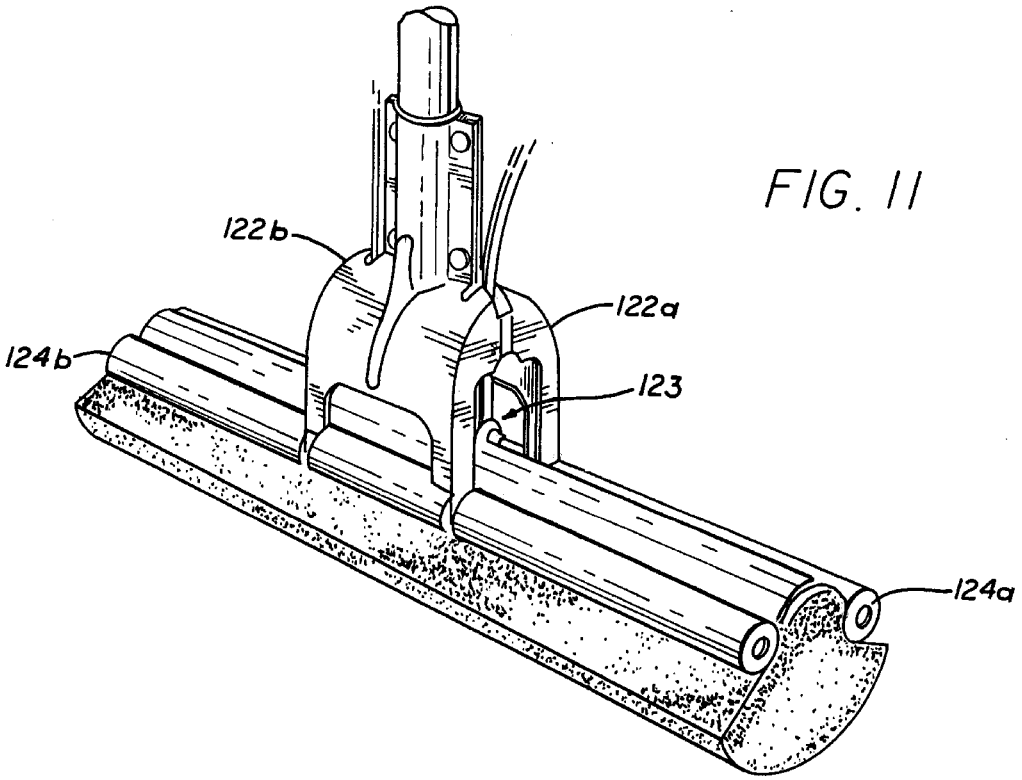
FIG. 11 is a perspective view of a conventional wringer head assembly.

Conventional wringer head assemblies, such as that shown in FIG. 11, include a pair of stamped metal plates 122*a* and 122*b* which support rollers 124*a* and 124*b*. There are a number of problems associated with this design. For example, the stamped metal plates can be easily bent, which in turn causes the rollers to become misaligned. The metal plates also flex excessively during wringing, which reduces the wringing efficiency of the mop head. Stamped plates also tend to be sharp, which can lead to scratched surfaces and injuries. In addition, dirt is often trapped in the corners of the plates and, because conventional head assemblies do not cover the open end of the mop handle, dirt and cleaning solution are also allowed into the handle. Finally, the stamped metal parts are configured such that they interfere with the removal and replacement of the mop assembly. Area 123, which is where the mop's actuator rods connect to the cleaning element assembly, is covered by plates 122*a* and 122*b*.

Figure 12:
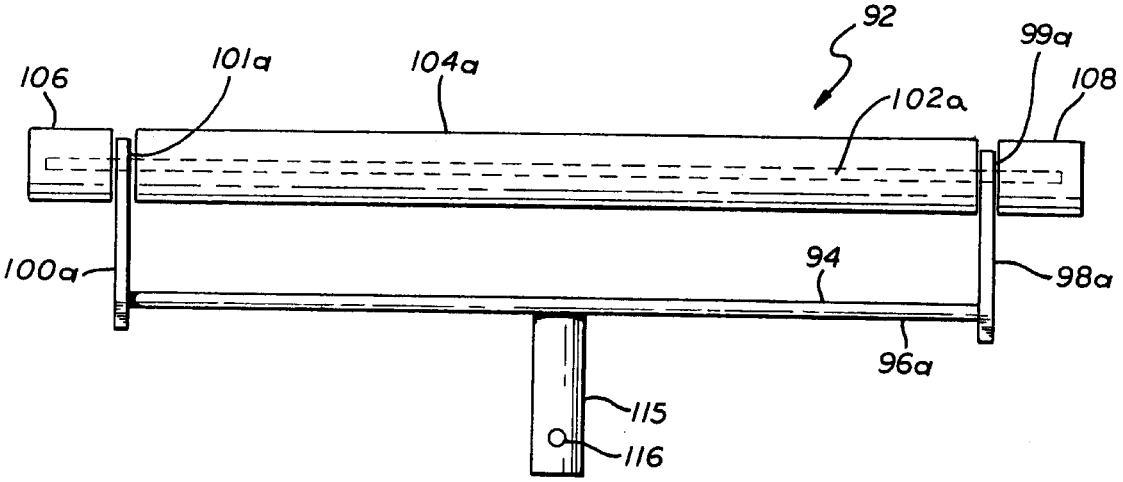
FIG. 12 is a front view of a wringer head assembly in accordance with the present invention.

Turning now to the present wringer head assembly, preferred embodiments of which are illustrated in FIGS. 12–16 and generally indicated by reference numeral 92, the assembly includes a base 94 to which a pair of support rods 96*a* and 96*b* are secured. The base also acts as a cover to close the top end of the handle. (Note FIG. 14.) Roller axis support members 98*a* and 100*a* are secured to opposite ends of rod 96*a*. Similarly, roller axis support members 98*b* and 100*b* (100*b* not shown) are secured to opposite ends of rod 96*b*. Two adjacent roller axis support members may, as shown by way of example in FIG. 15, form a single unitary structure. Alternatively, adjacent roller axis support members 98*a*' and 98*b*' may, as shown by way of example in FIG. 16, remain separate. Roller axis 102*a*, which supports a roller 104*a*, is itself supported by support members 98*a* and 100*a*, and its ends extend through apertures 99*a* and 101*a* formed in the support members. Similarly, roller axis 102*b*, which supports a roller 104*b*, is itself supported by support members 98*b* and 100*b*, and its ends extend through apertures 99*b* and 101*b* (not shown) formed in the support members. As shown in FIG. 12, the roller axis support member are located in such a manner that they will not interfere with removal or replacement of a cleaning element assembly.

Support rods 96*a* and 96*b* function as torsion rods to assist in controlling the amount of flexing in the direction indicated by arrows C during wringing processes. The size, shape and composition of the support rods may be selected so as to insure the proper amount of flex for a particular application. For example, in a common household mop, the rods may preferably be 300 series stainless steel or plated/painted spring steel. Additionally, in the embodiment illustrated in FIG. 15, a pair of relief grooves 114*a* and 114*b* may be formed in the unitary configuration for additional flex control. The grooves may be any suitable shape or size. Also, particular material(s) may be used to form the roller axis support members so that further flex control is provided.

A pair of end caps 106 and 108 are mounted on the ends of roller axis 102*a*. Although not shown in the drawings, a similar pair of end caps are mounted on roller axis 102*b*. The end caps may be configured such that their diameter is substantially equal to the diameter of the rollers and may also be formed from the same material as the rollers. Accordingly, the end caps may function as a portion of the rollers. The end caps advantageously prevent the roller axis from scratching the surfaces which the mop comes into contact with.

The bottom portions of roller axis support members 98*a*, 98*b*, 100*a* and 100*b* include an aperture 110*a*, 110*b*, 112*a* and 112*b* (112*a* and 112*b* not shown), respectively, that is adapted to receive an end of one of the support rods. Similar apertures 110*a*' and 110*b*' are shown in FIG. 16. The support rods may be secured within the apertures by welding, soldering or other means known to those of skill in the art.

As illustrated for example in FIGS. 12 and 14, a handle attachment member 115 extends from base 94 and has an aperture 116 formed therein. Aperture 116 is located such that it corresponds to an aperture 118 formed in a mop handle 120. The base and handle may, therefore, be secured to one another by inserting a screw, nut and bolt arrangement or quick-release locking pin into the aligned apertures. Such an arrangement allows the wringer head assembly or the handle to be relatively easily replaced. A seal, such as an O-ring seal, may be placed between handle 120 and base 94 when the wringer head assembly is secured to the handle to inhibit the flow of water or solvents between the handle and base.

An alternative wringer head assembly, generally indicated by reference numeral 126, is illustrated in FIG. 17. The assembly is primarily composed of a one-piece stainless steel plate 128 that is bent into the orientation shown. The bent portions include roller axis support members 130*a*, 130*b*, 132*a* and 132*b* and stiffening dimples 134*a–d*. The plate 128 includes a pair of holes 136*a* and 136*b* which reduce the weight of the assembly and a pair of holes 138*a* and 138*b* which the mop's actuation rods to connect to the cleaning element assembly. A handle attachment member 140, which includes a fastening hole 142, is secured to the plate 128, preferably by welding.

A number of other features may be incorporated into the present wringer head assembly. The metal parts may be electropolished and TeflonTM sleeves may be provided where a moving metal part is in contact with another metal part. In addition, a variety of rollers may be used. For example, the rollers may be textured, grooved, hard, soft, solid or perforated. Moreover, for those applications where a single use bouffant-type disposable cover is being used to cover the mop head, the wringer assembly may be adapted to include cutting devices, such as blades or hooks. The cutting devices engage the elastic band used to hold the cover on the mop head when wringer head assembly is actuated. Thus, the cover may be removed from the mop head and discarded after use without being touched by the user.

A cleaning element assembly 150 (FIG. 18), according to one preferred configuration, includes a cleaning element 152 and a mounting element 154 for mounting the cleaning element 152 to a suitable bracket or other support on a cleaning tool such as that previously described. In this embodiment, the cleaning element 152 includes a main body 156 extending in a longitudinal direction defined by a longitudinal axis 158 between cleaning surfaces designated generally at 160 and 162. It is to be understood that the cleaning surfaces 160 and 162 can take any number of shapes and configurations, and are not limited to any particular side of the cleaning element. For example, in FIG. 18, the cleaning surfaces of this embodiment extend not only along oppositely facing sides. 164 and 166, but also along portions of the adjacent longitudinally extending sides 168 and 170, and along the perpendicular end faces 172 and 174.

In the present embodiment, the cleaning element 156 is supported and positioned relative to a cleaning tool through at least one opening 176 preferrably extending longitudinally the entire longitudinal length of the cleaning element and also preferrably centered vertically and horizontally relative to the end faces 172 and 174. In this preferred embodiment, the opening 176 is a cylindrically shaped channel coaxial with the axis 158.

In the preferred embodiment, the cleaning element 156 is supported by a support assembly having a first support element extending at least partly through the opening 176 and a second support element extending either across an external surface of the cleaning element or through a corresponding opening in the cleaning element in order to support and hold the cleaning element in place and to keep the cleaning element stable. In the embodiment shown in FIG. 18, the mounting and supporting element includes a first or intermediate supporting bar 177 and a second supporting bar 178. In this embodiment, the intermediate supporting element or center bar extends entirely through the channel 176 and the second supporting element or interface bar 178 extends along the external surface 156 of the cleaning element in such a manner that the material of the cleaning element between the intermediate bar 177 and the interface bar 178 is sandwiched between the two bars in order to support and stabilize the cleaning element relative to the mounting bracket 154. The opposite adjacent ends of the intermediate and interface bars are spaced apart a suitable distance and are linked together in such a fashion as to securely sandwich the material of the cleaning element between the two bars. For example, the ends of the bars of one end can be linked through a pivot or hinge and the other ends can be releaseably linked through a lever and cam arrangement or other linking means.

Figure 18:
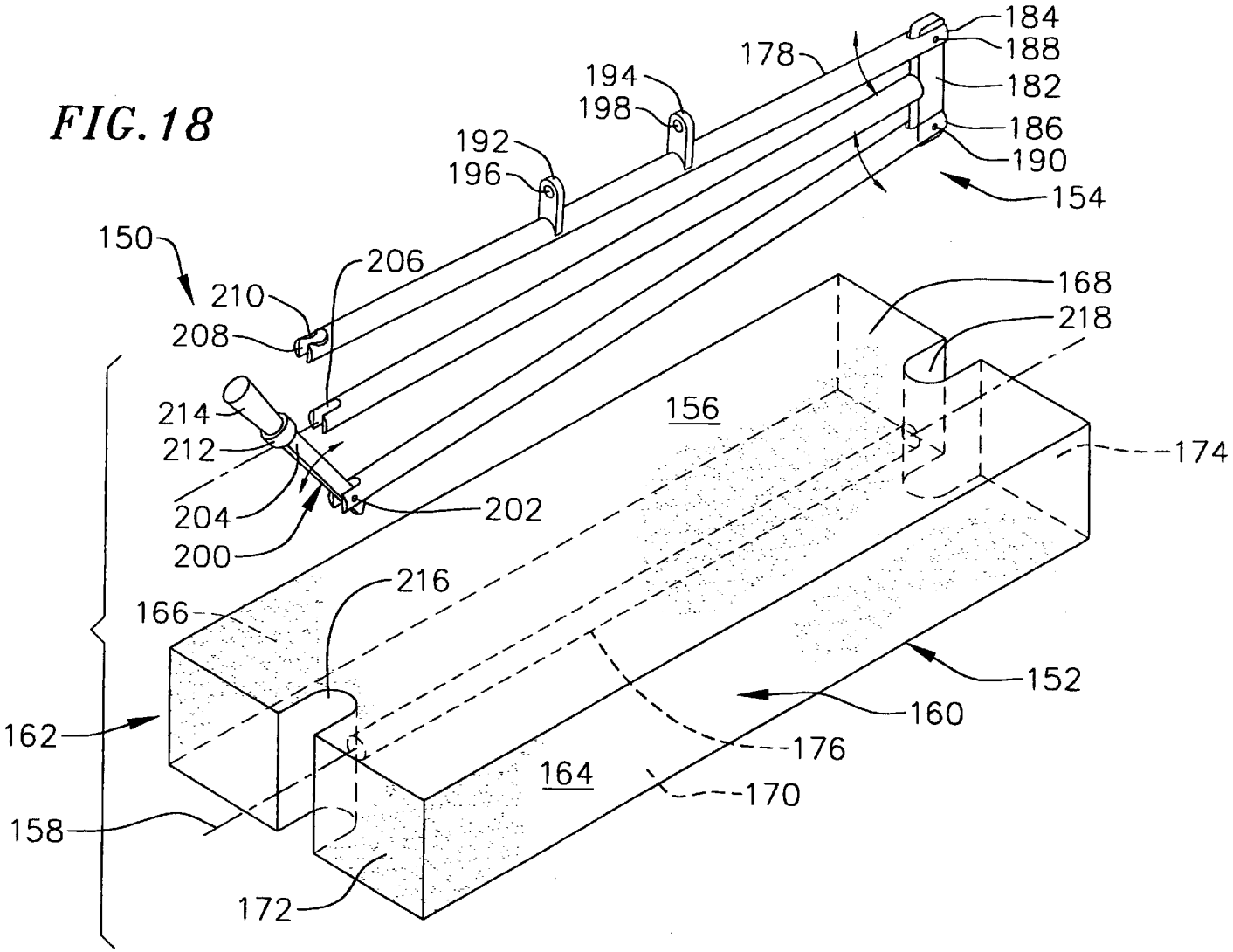
FIG. 18 is a perspective and exploded view of a cleaning element assembly in accordance with another aspect of the present inventions.
Figure 19:
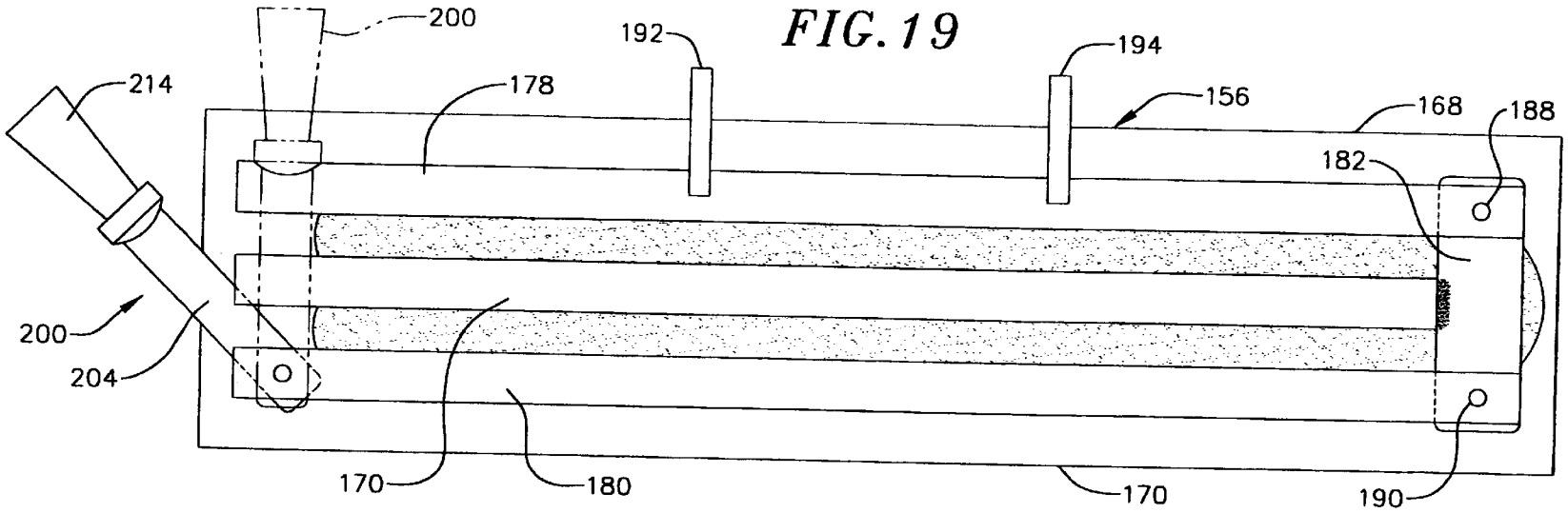
FIG. 19 is a vertical cross-section through a cleaning element assembly showing a cleaning element supporting bracket supporting and positioning a cleaning element.

In the preferred embodiment shown in FIG. 18, the mounting element includes a third support bar 180 extending parallel to the intermediate bar 177 on the opposite side of the intermediate bar 177 from the interface bar 178. In this embodiment, though not necessarily, the third bar 180 extends along the external surface of the cleaning element opposite the surface 156 in order to further support, stabilize and hold the cleaning element between the respective bars.

The support element 154 includes a first cross-bar 182 centered on the intermediate bar 177 for linking adjacent ends 184 and 186 of the interface bar 178 and the third bar 180, respectively. The cross bar 182 is preferrably fixed, welded or otherwise attached to the intermediate bar 177 forming a "T" and includes pivot pins 188 and 190 for pivotally supporting adjacent ends of the interface bar 178 and third support bar 180, respectively. Preferrably, the cross bar 182 is a flat bar sandwiched or inserted in between respective grooves formed in the ends of the interface bar and third bar. The cross piece 182 is dimensioned in such a way as to reliably and securely position and hold the cleaning element between the bars.

The interface bar 178 includes mounting elements or tangs 192 and 194, each including respective mounting elements such as holes 196 and 198 for mounting the interface bar, and therefore the mounting element 154 to a bracket on a tool such as the mop described previously.

The third bar preferrably includes a latching element in the form of a latching cross bar 200 for engaging one or both of the intermediate bar 177 and interface bar 178. In the preferred configuration, the latch 200 is pivotally linked in a slot in the third bar through a pivot pin 202 and includes a flat bar portion 204 extending from the pivot pin 202 a distance sufficient to engage and rest in a latch groove 206 in the end of the intermediate bar 177 opposite the cross bar 182 and also, preferrably, the groove 208 in the end of the interface bar 178 opposite the cross bar 182. The latch bar 200 preferrably engages and holds the intermediate, interface and third bars in such a way as to support, retain and hold the cleaning element in a stable position for use.

The form of coupling the two or more bars in order to hold the cleaning element may take any number of forms, but a preferred configuration shown in FIG. 18 includes a recessed surface 210 formed in the side of the interface bar 178 opposite the intermediate bar 177 for engaging a boss 212 on the latch bar 200 opposite the pivot pin 202. The surface 210 and the boss 212 are dimensioned in such a way as to permit reliable latching under normal use. The latch bar is moved and positioned through a latch handle 214 adjacent the boss 212.

In the preferred form of the assembly, the cleaning element includes first and second grooves 216 and 218 formed in the side surfaces 172 and 174, respectively, to accept and recess the latch bar 200 and cross bar 182, respectively, thereby protecting those bars from impact during use and also to minimize the possibility of those bars contacting surfaces being cleaned. The depth of the grooves 216 and 218 are dimensioned sufficiently to recess the bars the desired amount.

The cleaning element assembly of FIG. 18 provides for more stable, reliable and useful cleaning element such as for mops. The two and three bar supports and sandwiching for the cleaning element help to stabilize the cleaning element during use, especially when the cleaning element is saturated or moistened with water and/or solvents. Wet cleaning elements tend to migrate or bunch on the support during use, and the mounting element 154 of FIG. 18 reduces the tendency of the cleaning element to migrate relative to the support element 154. The assembly is also easy to use, especially during installation on a mop, for example, and also during replacement of cleaning elements. The mounting element 154 is placed around a cleaning element 152 by inserting the intermediate rod 177 in the channel 176 followed by pivoting of the interface bar 178 and third bar 180 on opposite surfaces of the cleaning element to position and securely hold the cleaning element between the bars. Latch bar 200 is then secured in place, afterwhich the assembly is ready for use or mounting on a tool such as the mop.

Figure 20:
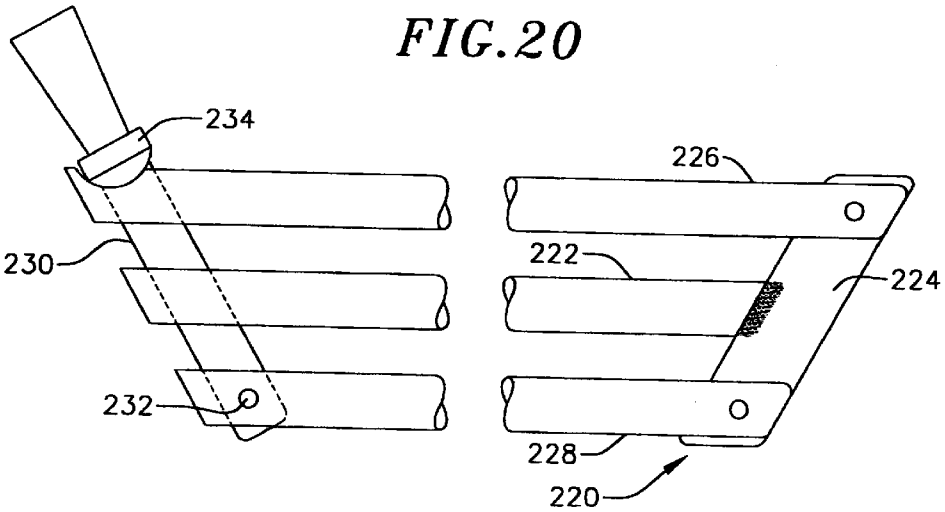
FIG. 20 is a partial front elevation view of a cleaning bracket of FIGS. 18 and 19 according to a further embodiment of the bracket.

An alternative mounting element 220 (FIG. 20) has bars of different lengths in order to further minimize the possibility of hardware contacting surfaces being cleaned, and making it easier to recess the cross bar and latch bar in the cleaning element. Specifically, an intermediate bar 222 is preferrably fixed to a cross bar 224 to which is pivotally attached an interface bar 226 and a third bar 228. The third bar 228 is shorter than the intermediate bar 222, which in turn is shorter than the interface bar 226. A latch bar 230 is pivotally supported by the third bar 228 through a latch pin 232, and a boss 234 engages a corresponding groove surface in the interface bar 226.

Figure 22:
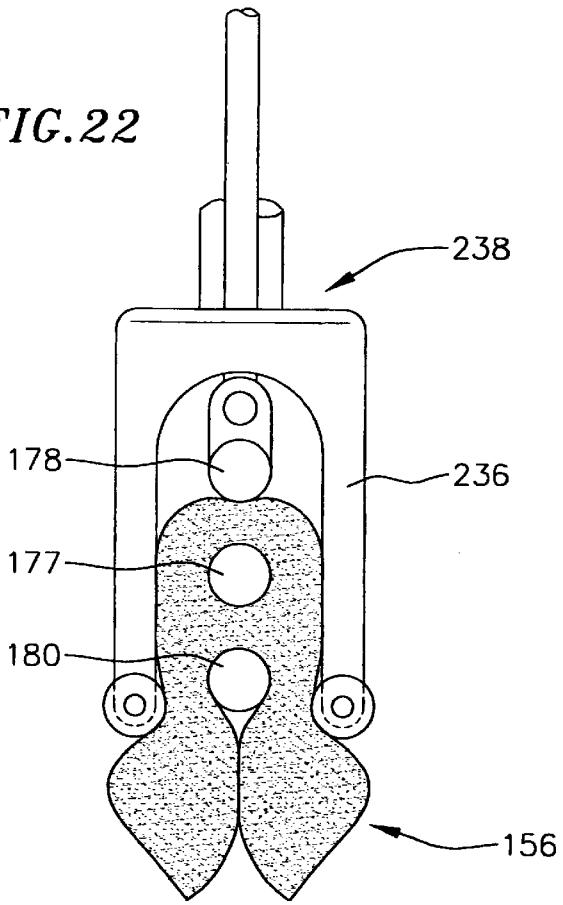
FIG. 22 is a side elevation view of the assembly of FIG. 21 showing the cleaning element assembly being wrung out.
Figure 21:
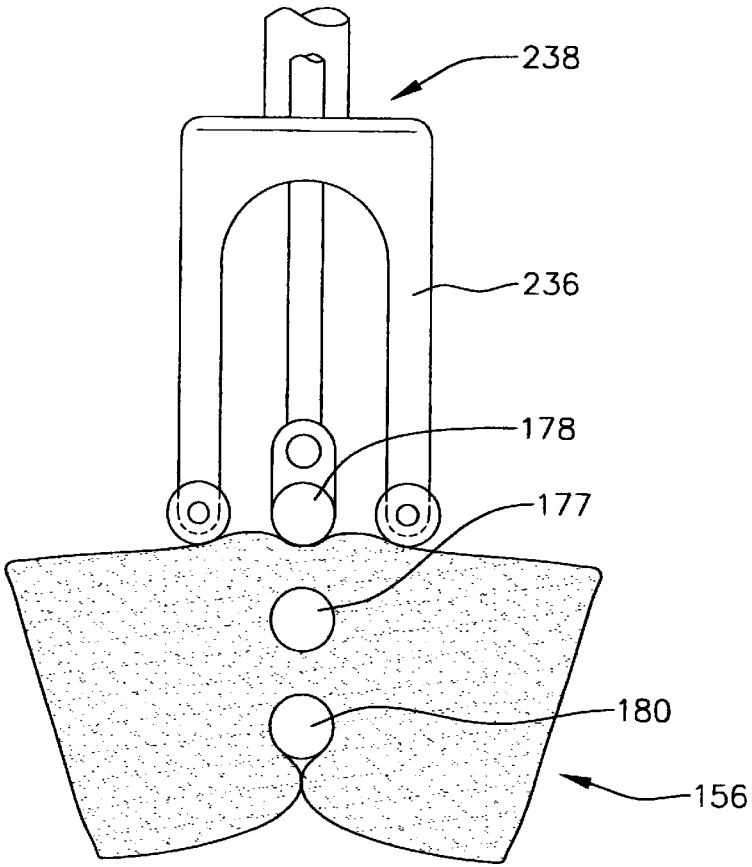
FIG. 21 is a side elevation view of a cleaning element assembly mounted to a bracket, such as for a mop or other cleaning tool, in a configuration use for cleaning.

FIGS. 21 and 22 show the support, engagement and inter-relationship between a cleaning element assembly and a support bracket 236 on a cleaning tool such as a mop 238. The mounting bracket 236 and the mop assembly 238 are similar to the mop previously described. FIG. 21 shows the cleaning element assembly in a configuration for cleaning, while the mop shown in FIG. 2 is shown in wringing configuration.

Figures 23, 24:
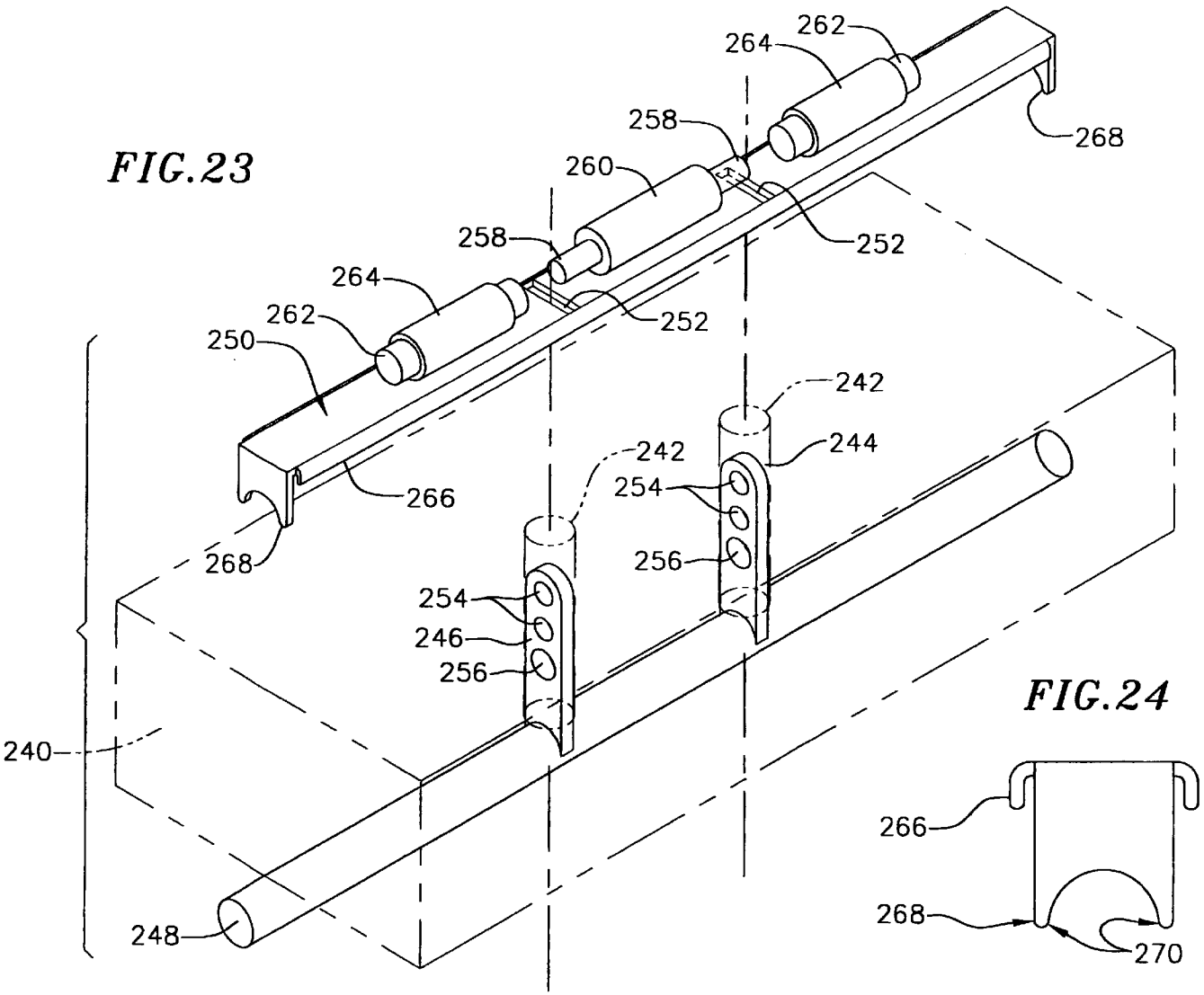
FIG. 23 is a perspective and exploded view of another bracket assembly in accordance with another aspect of the present inventions.
FIG. 24 is an end elevation view of a top bracket of FIG. 23.

FIGS. 23 and 24 show alternate configurations for a cleaning element assembly using at least two supporting or retaining elements to hold and stabilize the cleaning element relative to the tool by which it is supported. A cleaning element 240 is shown in phantom and would include one or more openings 242 extending through the cleaning element 240. The openings 242 accept tangs or bars 244 and 246 on a holding bar 248 for engagement with a pressure bar 250. The pressure bar 250 includes slots or other mating elements 252 formed in the surface of the bar 250 to accept the elements 244 and 246. Engagement of the elements 244 and 246 with the slot 252 and subsequent pressing of the bar 248 and the bar 250 together will sandwich or position the cleaning element 240 between the bars 248 and 250, thereby securely holding the cleaning element in place during use for engaging mounting elements on a mop bracket or other hardware.

Latching holes 256 are formed in the bars 244 and 246 in order to permit latching of the bar 248 with the pressure bar 250 through latching pins 258. The latching pins are preferrably retained and supported by a pin cylinder 260 containing one or more springs for biasing the pins 258 outwardly while at the same time retaining the pins 258 relative to the cylinder so that the pins 258 have a limited travel sufficient to engage the openings 256 for latching.

Disengagement cylinders 262 can be used to manually depress the engagement pins 258 to either permit insertion of the bars 244 and 246 past the pins 258 or to release the pins 258 from the corresponding holes 256 to separate the bars 248 and 250. The release elements 262 are preferrably formed from Delrin and are held in place by suitable pins or other elements to prevent the pins from falling out of mounting cylinders 264.

More than one latching hole 256 can be included on the bars 246, as desired. The bars 246 may be angled inwardly towards each other or outwardly away from each other in order to facilitate insertion of the bars into the cleaning element holes 242 and guiding of the bars 244 and 246 through the slots 252 in the pressure bar 250. The edges of each bar 256 on each side of the holes 254 and 256 can be curved inwardly or concave as viewed from a point between the two bars 244 and 246 to also facilitate engagement of the bar 248 with the bar 250 and latching. Furthermore, the thickness of each bar 244 and 246 may be reduced as the bar extends further away from the bar 248. This also may facilitate engagement of the bars 248 and 250 as well as latching.

The pressure bar 250 may include surfaces 266 and 268 for more securely engaging the cleaning element. The surface 268 includes discontinuities in the form of teeth 270 to engage the cleaning element, which may be foam material or other similar material (FIG. 24). Other holding elements may be used on one or more of the bars in order to more securely engage or hold the cleaning element relative to the hardware or bars 248 and 250.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A cleaning element assembly comprising:

a cleaning element having at least one surface defining at least one opening extending longitudinally of the cleaning element such that the cleaning element is supported and positioned relative to a cleaning tool through the at least one opening and having a second surface; and a mounting element having a cleaning element support for supporting the cleaning element on a cleaning tool so that the cleaning element support is substantially centered relative to a first dimension of the cleaning element and wherein the mounting element includes a first support element extending at least partly through the at least one opening so that the first opening is substantially centered transversely relative to the first dimension and a second support element extending across the second surface of the cleaning element to support the cleaning element in place.

2. The cleaning element assembly of claim 1 wherein the cleaning element includes a main body extending in a longitudinal direction defined by a longitudinal axis between at least first and second cleaning surfaces.

3. The cleaning element assembly of claim 2 wherein the main body includes first and second side surfaces and wherein each side surface includes a respective wall defining a groove forming a recess in the main body inward from the side surfaces.

4. The cleaning element assembly of claim 2 wherein the at least first and second cleaning surfaces include first and second oppositely facing sides connected by at least third and fourth sides to form a main body having a rectangular cross section and wherein the longitudinal axis extends in a direction substantially parallel to the first and second cleaning surfaces.

5. The cleaning element assembly of claim 4 wherein the longitudinal axis is substantially centered between the first and second cleaning surfaces, wherein the third and fourth cleaning surfaces are oppositely facing and wherein the longitudinal axis is substantially centered between the third and fourth cleaning surfaces.

6. The cleaning element assembly of claim 1 wherein the at least one opening extends completely through the cleaning element.

7. The cleaning element assembly of claim 6 wherein the cleaning element includes at least one end face wherein the at least one opening extends through the cleaning element from the at least one end face and wherein the at least one opening is substantially centered on the at least one end face.

8. The cleaning element assembly of claim 1 wherein the second surface of the cleaning element is an outer surface of the cleaning element and wherein the first support element and the second support element sandwiches a portion of the cleaning element between the first and second support elements.

9. The cleaning element assembly of claim 1 wherein the at least one opening in the cleaning element extends entirely through the length of the cleaning element and wherein the first support element extends entirely through the at least one opening, and wherein the second support element extends across an external surface of the cleaning element.

10. The cleaning element assembly of claim 9 wherein the cleaning element external surface is substantially flat and wherein the second support element extends across the substantially flat external surface of the cleaning element.

11. A cleaning element assembly comprising:

a cleaning element having at least one surface defining at least one opening extending longitudinally of the cleaning element such that the cleaning element is supported and positioned relative to a cleaning tool through the at least one opening and having a second surface;

a mounting element for supporting the cleaning element on a cleaning tool, having a first support element extending at least partly through the least one opening and a second support element extending across the second surface of the cleaning element to support the cleaning element in place; and further comprising a connecting element and wherein the first and second support elements extend substantially parallel to each other when the cleaning element and mounting element are assembled, and wherein the first and second support elements are linked by the connecting element allowing at least one of the first and second support elements to pivot relative to the connecting element.

12. The cleaning element assembly of claim 11 further including a second connecting element for maintaining the second support element in position relative to the first support element.

13. The cleaning element assembly of claim 12 wherein the second connecting element pivots with respect to at least one of the first and second support elements.

14. The cleaning element assembly of claim 12 further including a holding element for holding the first and second support elements at a relative fixed spacing with respect to each other.

15. The cleaning element assembly of claim 14 wherein the holding element includes a lever and cam assembly.

16. A cleaning element assembly comprising:

a cleaning element having at least one surface defining at least one opening extending longitudinally of the cleaning element such that the cleaning element is supported and positioned relative to a cleaning tool through the at least one opening and having a second surface;

a mounting element for supporting the cleaning element on a cleaning tool, having a first support element extending at least partly through the least one opening and a second support element extending across the second surface of the cleaning element to support the cleaning element in place; and a third support element extending substantially parallel to the first and second support elements.

17. The cleaning element assembly of claim 16 wherein the third support element extends on a side of the first support bar substantially opposite the second support bar.

18. The cleaning element assembly of claim 17 wherein the third support element engages a surface of the cleaning element to sandwich the surface of the cleaning element between the third support element and the first support element.

19. The cleaning element assembly of claim 16 wherein the first, second and third support elements are linked by a first cross bar such that the second and third support elements can pivot relative to the cross bar, and further including a second cross bar at an end of the first support element opposite the first cross bar for engaging respective ends of the first and third support elements.

20. The cleaning element assembly of claim 19 wherein the first, second and third support bars have different lengths.

21. The cleaning element assembly of claim 19 wherein the first support element includes an engagement element for engaging the second cross bar.

22. The cleaning element assembly of claim 20 wherein the second cross bar has a subtantially flat portion and the first support element includes a groove for engaging the flat portion on the second cross bar.

23. A cleaning element assembly comprising a cleaning element having a first surface defining at least one opening extending longitudinally through the cleaning element; a mounting element for supporting the cleaning element on a cleaning tool, having a first support element extending through the at least one opening, a second support element extending across a second outside surface of the cleaning element and a third support element extending across a third outside surface of the cleaning element to sandwich the cleaning element between the third and first support elements and between the second and first support elements.

24. The cleaning element assembly of claim 23 wherein the first, second and third support elements include respective first and second ends, and further including first and second side bars wherein the first ends of the support elements are coupled by the first side bar allowing pivotal movement of at least two of the support elements relative to the side bar and the second side bar for engaging the second respective ends of the first, second and third support elements.

25. The cleaning element assembly of claim 24 wherein the second side bar pivotally engages the second support element and positions the third support element.

26. The cleaning element assembly of claim 23 wherein the first, second and third support elements have different lengths.

27. A cleaning element assembly comprising:

a cleaning element having at least one opening extending through the cleaning element from a first side to a second side, a first holding element having at least one bar having at least one engagement surface extending from the at least one bar and extending through the at least one opening in the cleaning element and a second holding element having a second bar having at least one wall defining a second engagement surface for engaging the at least one engagement surface so that at least part of the cleaning element is positioned between the first and second holding elements.

28. The cleaning element assembly of claim 27 further including a detent element for engaging the latching element when the latching element is positioned through the opening in the second support element.

29. A cleaning element assembly comprising:

a cleaning element having a first surface and a second surface defining parts of an outside surface of the cleaning element, and a third surface defining an opening through the cleaning element and wherein the first surface and the third surface are spaced apart by a first distance; and a mounting element including a first cleaning element support extending through the opening and a second cleaning element support extending across the first surface wherein the first cleaning element support and the second cleaning element support compress a portion of the cleaning element.

30. The cleaning element assembly of claim 29 wherein the opening is substantially centered in the cleaning element.

31. The cleaning element assembly of claim 29 wherein the second cleaning element support includes an attachment surface for attachment to a handle and wherein the first cleaning element support, the second cleaning element support and the attachment surface are substantially aligned.

32. The cleaning element assembly of claim 29 further comprising a third cleaning element support extending along the second surface.

33. The cleaning element assembly of claim 32 wherein the third cleaning element support and the first cleaning element support compress a portion of the cleaning element.

34. The cleaning element assembly of claim 29 wherein the cleaning element includes a first length and the first and second cleaning element supports include a second length greater than the first length.

35. The cleaning element assembly of claim 29 wherein the first and second cleaning element supports include a first longitudinal dimension and a width-wise dimension substantially less than the first longitudinal dimension.

36. The cleaning element assembly of claim 35 wherein the first and second cleaning element supports are formed as bars.

37. The cleaning element assembly of 36 wherein a second cleaning element support bar includes a handle attachment surface.

38. The cleaning element assembly of claim 29 further comprising a third cleaning element support and wherein a portion of the cleaning element is compressed between the first cleaning element support and the second cleaning element support and wherein a portion of the cleaning element is compressed between the first cleaning element support and the third cleaning element support.

39. A cleaning element assembly comprising:

a cleaning element having at least one surface defining at least one opening extending longitudinally of the cleaning element such that the cleaning element is supported and positioned relative to a cleaning tool through the at least one opening and having a second surface; and a mounting element for supporting the cleaning element and including a first bar passing through the at least one opening having first and second end portions and further including a second cleaning element support having first and second end portions and wherein the first and second end portions of the first bar and the first of second end portions of the second cleaning element support, respectively, are linked together.

* * * * *